US009982498B1

(12) United States Patent
Shick, Jr.

(10) Patent No.: US 9,982,498 B1
(45) Date of Patent: May 29, 2018

(54) FLUID REMOVAL DEVICE AND METHOD

(71) Applicant: Glenn Shick, Jr., Oak Ridge, PA (US)

(72) Inventor: Glenn Shick, Jr., Oak Ridge, PA (US)

( * ) Notice: Subject to any disclaimer, the term of this patent is extended or adjusted under 35 U.S.C. 154(b) by 224 days.

(21) Appl. No.: 14/936,990

(22) Filed: Nov. 10, 2015

Related U.S. Application Data

(60) Provisional application No. 62/127,088, filed on Mar. 2, 2015.

(51) Int. Cl.
*E21B 7/06* (2006.01)
*E21B 21/08* (2006.01)
*E21B 21/10* (2006.01)

(52) U.S. Cl.
CPC ..... *E21B 21/103* (2013.01); *E21B 7/06* (2013.01); *E21B 21/08* (2013.01)

(58) Field of Classification Search
CPC ... E21B 7/04; E21B 7/06; E21B 21/08; E21B 21/103
See application file for complete search history.

(56) References Cited

U.S. PATENT DOCUMENTS 4,448,267 A 5/1984 Crawford, III et al.
5,269,384 A * 12/1993 Cherrington ..... E21B 7/28 175/102
5,375,669 A * 12/1994 Cherrington ..... E21B 7/28 175/102
6,662,644 B1 12/2003 Grotendorst et al.
7,066,247 B2 * 6/2006 Butler ..... E21B 21/001 166/105
7,168,492 B2 1/2007 Laplante et al.
7,299,880 B2 11/2007 M Logindice et al.
7,451,828 B2 11/2008 Marsh
8,733,449 B2 5/2014 Ehtesham et al.
8,869,915 B2 10/2014 Knolle
8,955,599 B2 2/2015 Quigley et al.
2011/0209879 A1 9/2011 Quigley et al.
2012/0186881 A1 * 7/2012 Halderman ..... E21B 7/04 175/66
2016/0153268 A1 * 6/2016 Vasques ..... E21B 43/122 166/298

OTHER PUBLICATIONS

"How Does Directional Drilling Work?" Rigzone, http://www.rigzone.com/training/insight.asp?insight_id=295&c_id=1.
"Directional Drilling," Wikepedia, https://en.wikipedia.org/wiki/Directional_drilling.
Charles W. Hair, "Site Investigation Requirements for Large Diameter HDD Projects," Dec. 15, 1994, http://www.fws.gov/midwest/endangered/permits/hcp/nisource/2011NOA/pdf/N.

* cited by examiner

*Primary Examiner* — Matthew R Buck
(74) *Attorney, Agent, or Firm* — William F. Lang, IV; Lang Patent Law LLC

(57) ABSTRACT

A fluid removal device removes fluid and mud from a borehole during a directional drilling operation, thereby resisting any tendency of the fluid and mud to exit the borehole through any weaknesses that may be present within the surrounding soil. The fluid removal device is secured to a directional drill, and moved through the borehole, perhaps simultaneously with a reamer or a pipe to be installed within the borehole. Fluid and mud are collected within the device. Increased pressure, for example, from compressed air, is used to bias the fluid and mud out of the device and out of the borehole.

20 Claims, 8 Drawing Sheets

FLUID REMOVAL DEVICE AND METHOD

CROSS REFERENCE TO RELATED APPLICATION

This application claims the benefit of U.S. provisional patent application Ser. No. 62/127,088, which was filed on Mar. 2, 2015, and entitled "Unintended Discharge Prevention Device and Method."

TECHNICAL FIELD

The present invention relates to directional drilling. More specifically, a fluid collection/removal device and method is provided.

BACKGROUND INFORMATION

Directional drilling is commonly used for the drilling of oil and gas wells, as well as for the installation of pipe and other utilities in locations below surface regions where digging cannot occur. For example, the surface may contain wetlands; streams, rivers, or other water bodies; houses, or other things for which it is required or desired to leave them undisturbed. Drilling is performed from surface locations wherein drilling is acceptable, and the drill is guided along the desired path, sometimes to a second surface location, as described in greater detail below.

A typical directional drilling operation for laying pipe underground begins by drilling a pilot hole from a first location. The pilot hole is drilled using a drill string with an asymmetrical leading edge. The asymmetrical leading edge causes the drill to steer towards the "tool face" of the drill, and the drill can be steered by rotating the drill so that the tool face is oriented towards a desired travel direction. If travel in a straight line is desired, rotating the tool face will achieve this result. The tool face includes a hydraulic nozzle for cutting through soil. A probe that is located close to the leading edge sends a signal to the drill operator, informing the drill operator of the location of the drill and other information. The drill can thus be directed underneath a region that must be left undisturbed, and then directed upwards on the other side of that region.

Once the drill re-emerges from the ground, a reamer is attached to the drill, and the hole is reamed to a desired diameter. Reaming is also accomplished through hydraulic cutting. Simultaneously with reaming the hole, the pipe to be installed is pulled into the hole by retracting the drill.

The use of hydraulic cutting creates tremendous hydraulic pressure within the hole, not just from the cutting itself, but throughout the fluid that remains within the hole. This pressure can result in unintended discharges if there are any pre-existing holes or fissures within the soil, leading to fluid and/or mud entering undesirable locations, which could potentially include the very regions that directional drilling is being used to protect. This fluid is preferably extracted during cutting, but present methods of extraction do not relieve sufficient pressure to prevent unintended discharges.

An example of a presently available system is disclosed in U.S. Pat. No. 8,869,915, which discloses a system for sonic subsurface material removal. The system includes an outer tube that is attachable to a drill string. An inner tube is disposed within the outer tube, defining an annular region between the inner and outer tubes. Air, water, or other pressurized fluid can be injected into the borehole through the annular region between the inner tube and the outer tube. As the air, water, or other pressurized fluid goes into the borehole, below the waterline, and then back out through the inside of the inner tube, it carries with it sand or other materials for which removal is desired.

U.S. Pat. No. 6,662,644 discloses a formation fluid sampling and hydraulic testing tool. The sampling device is attached between the drill bit and the drill string. The device includes an outer tube having a plurality of holes, with each of the holes having a filter made from a stainless steel screen. An inner tube is disposed within the outer tube, defining an annular space between the inner and outer tubes. The annular space is sealed from the open ends of the outer tube. The upper end of the inner tube includes a spring biased valve that interfaces with a flanged sleeve. Holes within the flanged sleeve permit communication between the flanged sleeve and the annular space. During a drilling operation, drilling fluid is permitted to pass downward past the valve cone into the inner tube. The drilling fluid then passes through the bottom of the sampling device, driving the drilling bit. During normal drilling, the holes within the flanged sleeve are closed by another sleeve that is pushed downward by pressure from the drilling fluid. To obtain a sample, the flow of drilling fluid is halted. A pump is submerged into the drilling pipe to pump out the drilling fluid. The resulting underpressure raises the sleeve within the flanked sleeve, thereby exposing the holes within the flanged sleeve. The fluids to be sampled enter the annular space between the inner and outer tube through the holes defined within the outer tube. After passing through the annular space, the fluid to be sampled passes through the holes within the flanged sleeve, and can be pumped out of the open upper end of the sampling device.

U.S. Pat. No. 4,448,267 discloses a door drilling Kelly. The device includes a hollow shaft with doors in various positions along its length. The device can be fitted with a lifting bale at its upper end and a cutting bit at its lower end. After the borehole is pre-drilled, the Kelly is placed within the borehole, and an airlift reverse flow system is applied to the inlet or cutting bit. Drilling fluid and cuttings are caused to circulate up the hollow body to the unlatched door. Torque is applied to the Kelly, twisting the cutting bit, so that submerged earth is loosened and lifted to the inlet of the bit, drawn within the Kelly, and transmitted to the unlatched door. Whenever the Kelly is advanced so that the unlatched door approaches the level of the drilling fluid surface, drilling is interrupted, the doors latched, and the next-door is unlatched.

U.S. Pat. No. 7,299,880 discloses a diverter tool having a surge reduction bypass valve. The diverter tool forms part of a running string for running casing down a wellbore, and is disposed between a running pipe and a drill pipe. The diverter tool includes an upper end, a lower end, and a port body therebetween. The upper end includes a flapper body that is closed by pressure from within the diverter tool, and opened downward by pressure from above the diverter tool. The port body includes a plurality of ports for permitting passage of fluid therethrough. A sleeve extends downward from the flapper body, through the port body, and is biased by a spring to a position wherein it blocks the ports. Upward pressure on the flapper body from fluid within the port body causes the sleeve to move, exposing the ports and allowing the fluid to exit the pipe. If injecting fluid into the wellbore, for example, to clear a blockage, is desired, then the flapper is pushed open and the sleeve is pushed over the ports, permitting the fluid to pass through the running string.

U.S. Pat. No. 7,168,492 discloses a wellbore annulus flushing valve. The valve assembly includes a valve disposed within its upper portion that is spring biased into an open position, and which is structured to resist fluid flow traveling upward within the body of the valve assembly, while permitting fluid flow downward. A second valve located within a lower portion of the assembly is structured to resist fluid flow in a downward direction within the body, permitting some downward fluid flow, while permitting upward fluid flow. When the valve assembly is inserted into a wellbore as part of a cleaning string, a cylindrical mandrel holds the upper valve in its open position, and is itself retained in place by sheer pins. During a cleaning operation, fluid is generally permitted to flow upward through the cleaning string. However, if polluting materials such as oil deposits are brought to the surface, then fluid may be pushed downward into the cleaning string. The downward fluid flow closes the lower valve, so that continued downward fluid pressure will break the sheer pins and move the mandrel downward. Moving the mandrel downward enables the upper valve to function, and disables the lower valve. At this point, downward fluid flow will be permitted, but upward fluid flow will be resisted by the upper valve.

U.S. Pat. No. 8,955,599 discloses a system for removing fluids from a subterranean well. The system includes a pump within a horizontal section of the wellbore, and another pump for removing fluid from a vertical section of the wellbore. The fluid is removed through tubing, which may be a multilayer tubing having an outer section, an inner section, and an annulus between the inner and outer sections. Fluid may be separated into wanted portions and unwanted portions. Separation of wanted from unwanted fluids may occur either before or after removal from the wellbore. In some examples, wanted and/or unwanted fluids may be removed through the inner section of the tubing. In other examples, the unwanted fluids are transported to the surface through the annular region of the tubing, with wanted fluids being transported through the inner region of the tubing. The pumps may operate continuously or in response to sensors, and may operate simultaneously or sequentially. A similar device is disclosed in US 2011/0209879.

U.S. Pat. No. 8,733,449 discloses a selectively activatable and deactivatable wellbore pressure isolation device. The system includes a pair of valves that are structured to permit downward fluid flow and resist upward fluid flow. Each of the valves has an associated sleeve which, when positioned over the valve, restricts movement of the valve, permitting fluid flow in both directions. When the system is in the trip in mode, the first sleeve is retained in a position wherein the first valve is activated. The sleeve is maintained in this position by sheer pins, and is structured to be maintained in its other position by a snap-in mechanism. In the trip in mode, the second sleeve is held in a position so that the second valve is deactivated. Like the first sleeve, the second sleeve is held in this position by sheer pins, and in its other position by a snap-in mechanism. To transition the system to its operational mode, the first sleeve is transitioned to its second position to deactivate the first valve. To transition the device to its trip out configuration, the second sleeve is transitioned to its second position, thereby activating the second valve.

U.S. Pat. No. 7,451,828 discloses a downhole pressure containment system. The system includes upper and lower valves with actuators. The valves are selectively openable and closable using hydraulic, pneumatic, or telemetry means. After the bottom valve is closed, a fluid may be placed into the section between the valves. Once the fluid rises above the upper valve, the upper valve may be closed, and additional fluid added until the pressure reaches a predetermined level. Once the pressure reaches this level, the portions of the wellbore above and below the system are isolated, and a tool disposed above the valve may be removed. Some examples also include a downhole tool trap having a catcher flap that is in communication with the actuators for the valves described above.

Thus, although various means of controlling fluid and pressure within a bore during drilling and other operations are disclosed, a means of simultaneously performing a directional drilling operation and removing fluid from the wellbore to reduce pressure within the wellbore is not presently known. The pressure generated during a drilling operation is only useful at the location wherein drilling is actually occurring. Behind this location, such pressure only creates a risk that mud and fluid will exit through any areas of weakness that may exist in the surrounding soil, raising environmental concerns and resulting expenses. A tool which can be attached to a drill during a drilling or pipe installation operation, performing the fluid and mud removal function simultaneously with the drilling or installation operation, is therefore highly desirable to reduce the risk of unintended discharge.

Accordingly, there is a need for a mud and fluid extraction device and method that removes directional drilling byproducts with sufficient effectiveness to resist a buildup of pressure that could lead to unintended discharges. There is an additional need for a mud and fluid extraction device and method that leaves sufficient pressure at the tool face of the drill for effective cutting while relieving pressure behind the tool face. There is a further need for a device and method of mud and fluid extraction that can be incorporated into existing directional drilling equipment. Additionally, there is a need for a device and method of mud and fluid extraction that does not overcomplicate the directional drilling process, and which can be accomplished during the present directional drilling process.

SUMMARY

These needs are met by a fluid removal device. The fluid removal device has an elongated housing defining a front portion, a rear portion, and a central portion therebetween. The front portion of the housing defines at least one inlet. The back portion of the housing defines an outlet that is structured to be connected to a pipe or hose. The fluid removal device further includes a forward valve disposed within the front portion of the housing. The forward valve is structured to permit fluid flow from the central portion of the housing towards the inlet when the forward valve is open, and to resist fluid flow between the inlet and the central portion when the forward valve is closed. The forward valve is structured to close upon an increase in pressure within the central portion of the housing. The device also includes a rear valve disposed within the rear portion of the housing. The rear valve is structured to resist fluid flow between the central portion of the housing and the outlet when the rear valve is closed, and to permit fluid flow between the central portion and the housing when the rear valve is open. A pressure increasing system is included within the central portion of the housing. Increasing pressure within the central portion of the housing closes the forward valve and biases fluid within the central portion of the housing out of the outlet.

A method of directional drilling is also provided. The method includes drilling a pilot hole using a directional drill, and attaching a reamer to the directional drill. A fluid removal device is attached to the directional drill or to the reamer. The fluid removal device has an elongated housing defining a front portion, a rear portion, and a central portion therebetween. The front portion of the housing defines at least one inlet. The back portion of the housing defines an outlet that is structured to be connected to a pipe or hose. A forward valve is disposed within the front portion of the housing. The forward valve is structured to permit fluid flow from the central portion of the housing towards the inlet when the forward valve is open, and to resist fluid flow between the inlet and the central portion when the forward valve is closed. The forward valve is structured to close upon an increase in pressure within the central portion of the housing. The device further includes a rear valve disposed within the rear portion of the housing. The rear valve is structured to resist fluid flow between the central portion of the housing and the outlet when the rear valve is closed, and to permit fluid flow between the central portion and the housing when the rear valve is open. A pressure increasing system is provided within the central portion of the housing. The directional drill is retracted through the pilot hole. Fluid is collected within the fluid removal device. The fluid is discharged from the fluid removal device by increasing pressure within the fluid removal device.

Another method of directional drilling is also provided. The method includes drilling a pilot hole, and attaching a fluid removal device to a directional drill. The fluid removal device has an elongated housing defining a front portion, a rear portion, and a central portion therebetween. The front portion of the housing defines at least one inlet. The back portion of the housing defines an outlet that is structured to be connected to a pipe or hose. The device further has a forward valve disposed within the front portion of the housing. The forward valve is structured to permit fluid flow from the central portion of the housing towards the inlet when the forward valve is open, and to resist fluid flow between the inlet and the central portion when the forward valve is closed. The forward valve is structured to close upon an increase in pressure within the central portion of the housing. A rear valve is disposed within the rear portion of the housing. The rear valve is structured to resist fluid flow between the central portion of the housing and the outlet when the rear valve is closed, and to permit fluid flow between the central portion and the housing when the rear valve is open. A pressure increasing system is provided within the central portion of the housing. The directional drill is moved through the pilot hole. Fluid is collected within the fluid removal device. Fluid is discharged from the fluid removal device by increasing pressure within the fluid removal device.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
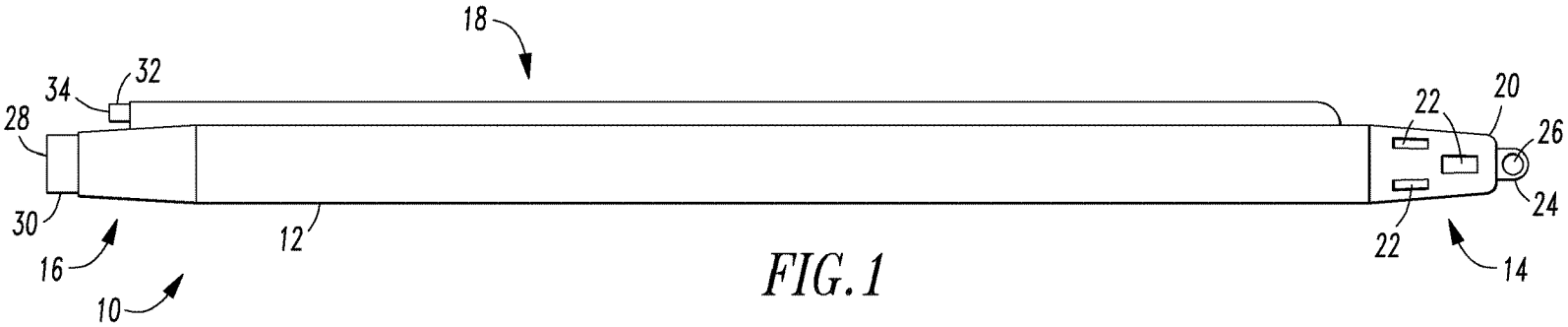
FIG. 1 is a side elevational view of a fluid removal device.

Referring to the drawings, a fluid removal device 10 is illustrated. The fluid removal device 10 includes an elongated housing 12 having a front portion 14, a back portion 16, and a central portion 18. The illustrated example of the housing 12 is made from a strong, rigid material, with some examples being made from a metal such as steel.

Figure 2:
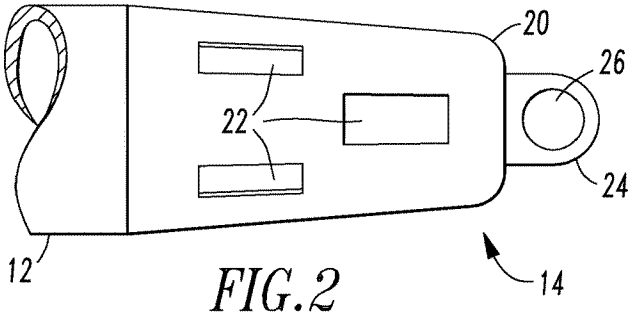
FIG. 2 is a side elevational view of a front end of the fluid removal device of FIG. 1.
Figure 3:
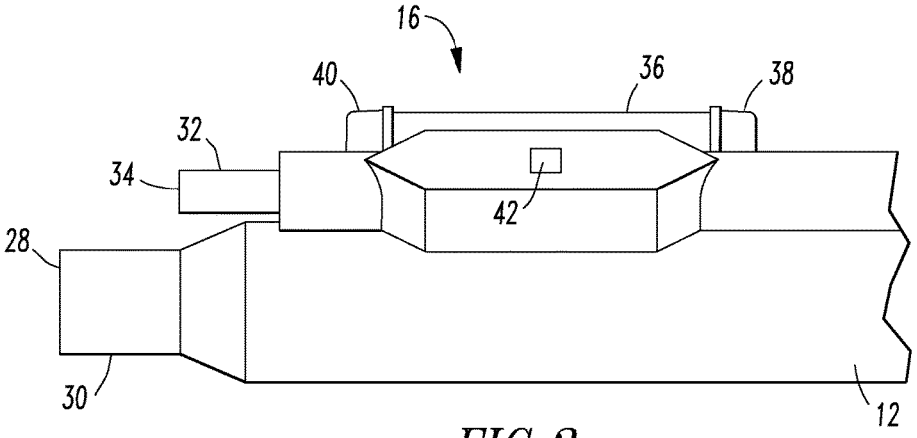
FIG. 3 is a perspective view of a back end of the fluid removal device of FIG. 1.
Figure 4:
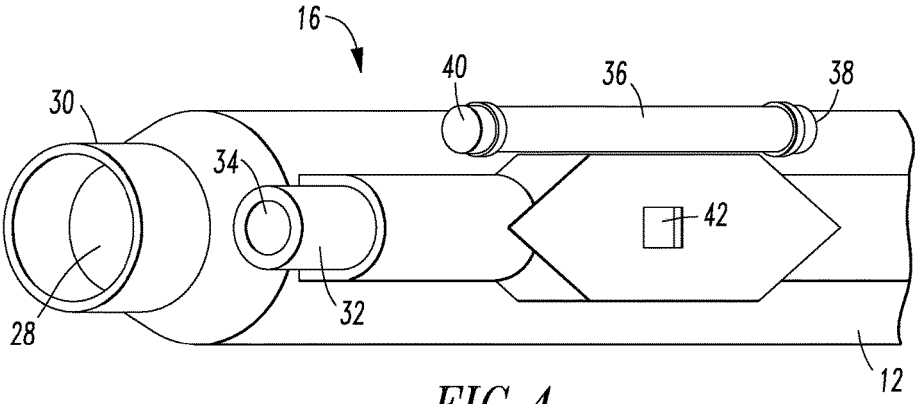
FIG. 4 is a perspective view of a back end of the fluid removal device of FIG. 1.
Figure 5:
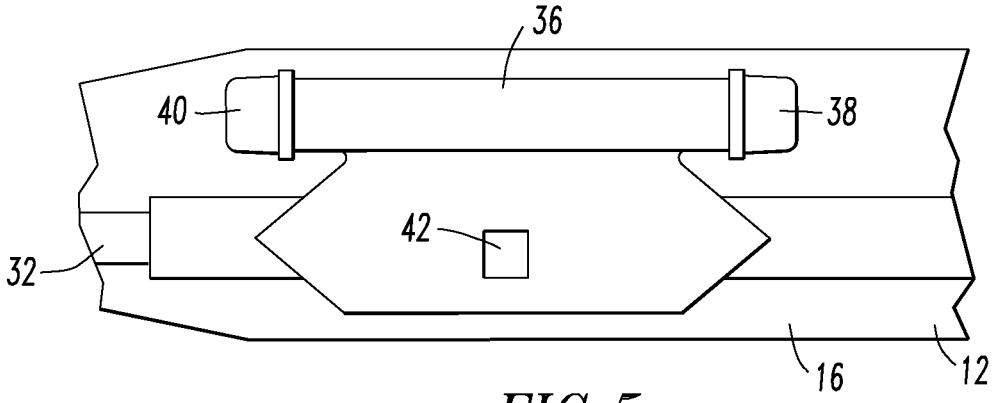
FIG. 5 is a top plan view of a back portion of the fluid removal device of FIG. 1.

Referring to FIGS. 1-2, the front portion 14 is generally tapered towards its front end 20 to facilitate passage through a borehole. The front portion 14 defines at least one inlet 22, with the illustrated example defining a plurality of inlets 22 around the periphery of the front portion 14. The illustrated example of the front portion 14 further includes a flange 24 defining a hole 26 therein. The flange 24 is structured to facilitate attachment of the device 10 to a directional drill that is being retracted through a bore hole, as described in greater detail below.

Referring to FIGS. 1 and 3-5, the rear portion 16 defines an outlet 28. In the illustrated example, the outlet 28 is surrounded by a circumferential flange 30. A conduit 32 includes an opening 34 at its rear end, with the conduit 32 being structured for attachment to a directional drill at the opening 34 as described in greater detail below. Although the illustrated example shows the outlet 28 being located substantially along the central axis of the housing 12, other examples may locate the opening 34 substantially along the central axis of the housing 12. A sensor housing 36 having removable end caps 38, 40 is also disposed on the illustrated example of a rear portion 16. The sensor housing 36 may house a sensor that is used to monitor the position of the drill tip as well as to provide other information in a manner that is well known to those skilled in the art of directional drilling. A vent opening 42, which will also be described in greater detail below, is also disposed within or adjacent to the rear portion 16 of the housing 12.

Figure 6:
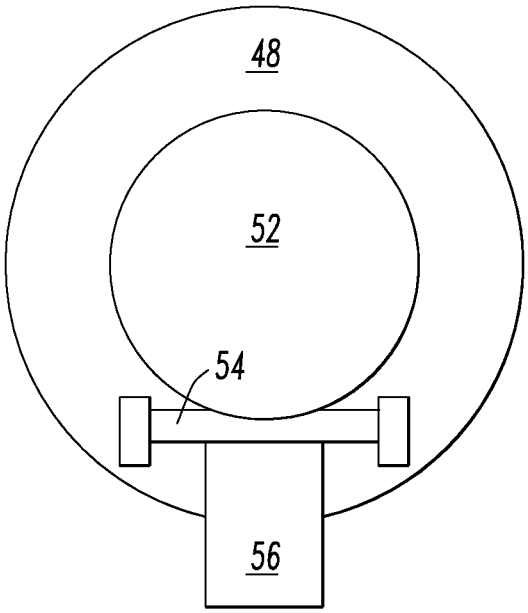
FIG. 6 is a rear elevational view of a forward valve of the fluid removal device of FIG. 1, showing the valve closed.
Figure 10:
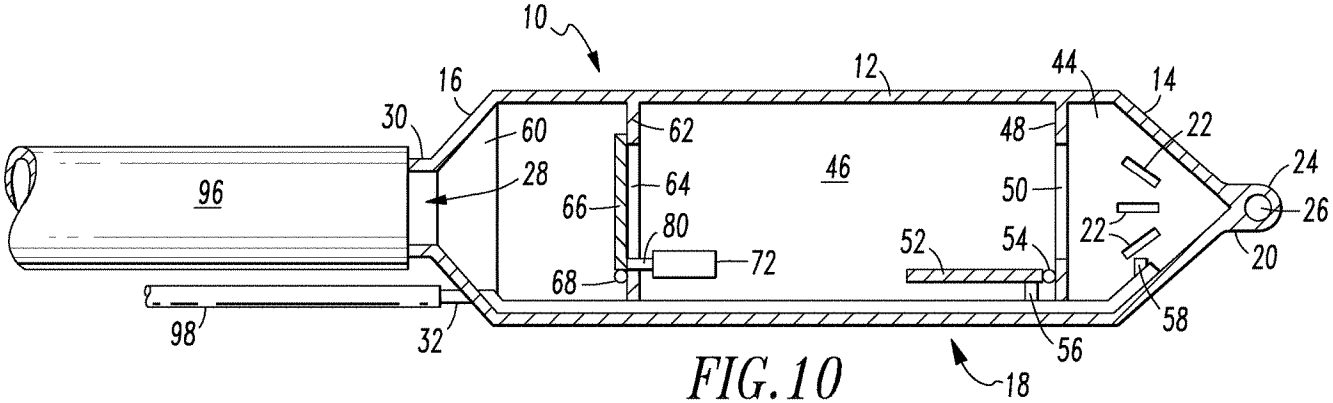
FIG. 10 is a cross sectional side view of a fluid removal device shown during fluid collection.
Figure 11:
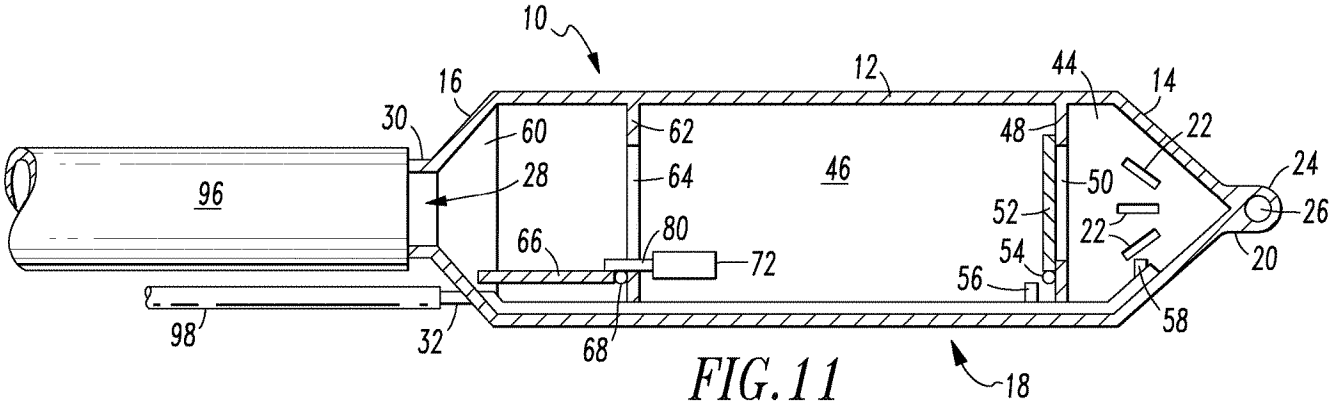
FIG. 11 is a cross sectional side view of a fluid removal device shown during fluid discharge.

Referring to FIGS. 6 and 10-11, the interior of the forward housing portion 14 is illustrated. The interior 44 of the front portion 14 is separated from the interior 46 of the central portion 18 by a wall 48 defining a generally central opening 50 therein. A door 52 is hingedly secured to the wall 48 by the hinge 54 adjacent to the opening 50, and is structured to close the opening 50 when the door 52 is in a closed position. The door 52 is further structured to pivot into the central interior 46 in order to open the door 52. The door 52 is generally in its open position during use of the device 10.

In the illustrated example, the door 52 is held in its open position by gravity, and is also biased towards its open position by a flow of fluid and mud from the forward interior 44 to the central interior 46, as described in greater detail below. A compressed air valve 56 is disposed adjacent to the door 52 within the central interior 46. The air valve 56 is operatively connected to the conduit 32, so that compressed air may be supplied to the air valve 56 from a directional drill and/or air compressor. As best shown in FIGS. 10-11, compressed air flowing from air valve 56 biases the door 52 into its closed position. Some examples of the device 10 may include a second air valve 58, which is also operatively connected to the duct 32, and which is disposed adjacent to the inlets 22. The air valve 58 may be used to apply air pressure to the inlets 22 to remove any obstructions that may be present within the inlets 22.

Figure 7:
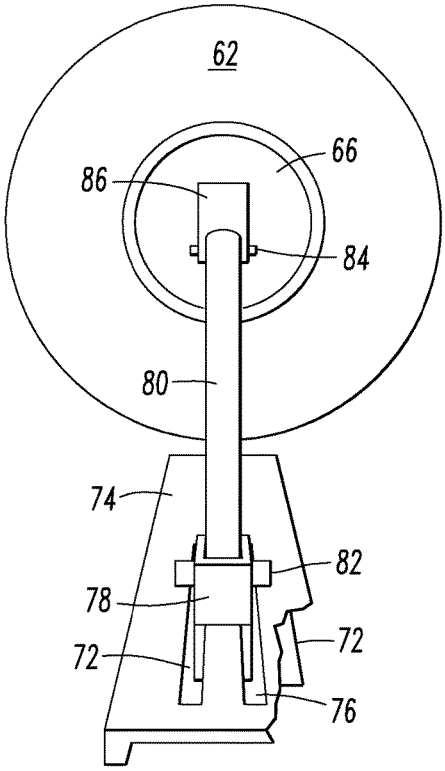
FIG. 7 is a front perspective view of a rear valve and vent of the fluid removal device of FIG. 1, showing the valve closed and vent open.
Figure 8:
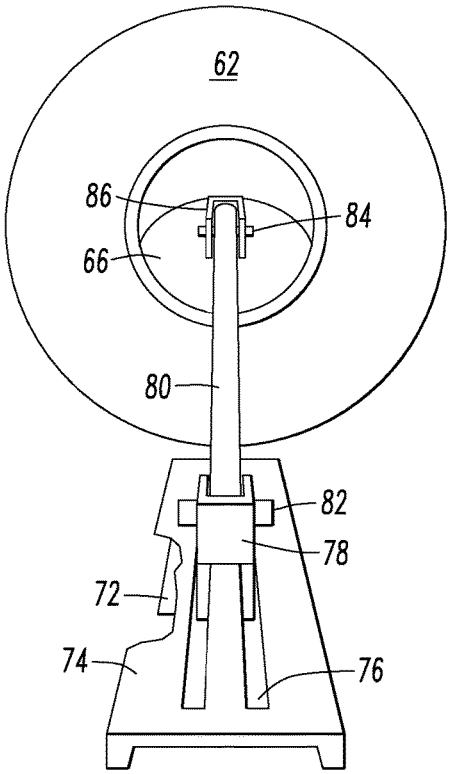
FIG. 8 is a front perspective view of the rear valve and vent of FIG. 7, showing the valve open and event closed.
Figure 9:
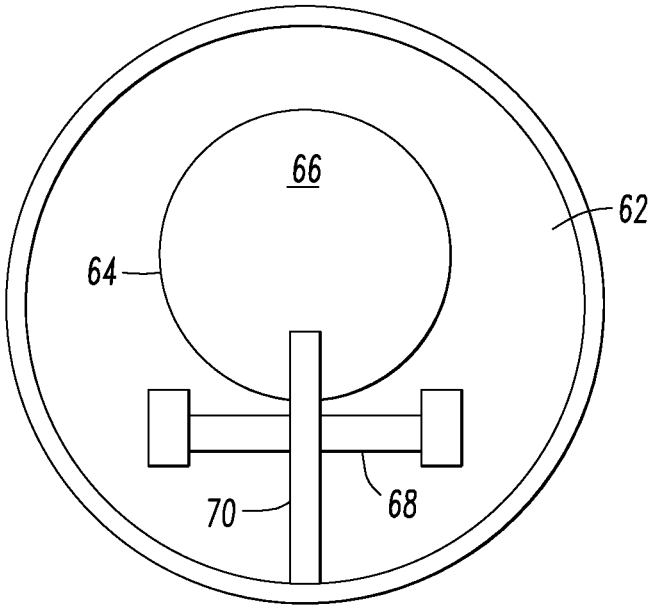
FIG. 9 is a back plan view of the rear valve of FIG. 7, showing the valve closed.

Referring to FIGS. 7-11, the rear portion 16 of the device 10 is illustrated. The central interior 46 is separated from the interior 60 of the rear portion 16 by a wall 62 defining a generally central opening 64 therein. A rear door 66 is pivotally secured to the wall 62 by a hinge 68, and is structured to close the opening 64 when the door 66 is closed. The door 66 is structured to open into the rear interior 60, until the door 66 reaches a position in which the door 66 abuts the door stop 70. As best shown in FIGS. 7-8, the rear door 66 is operatively connected to a vent door 72 that is structured to close the vent opening 42. In the illustrated example, the vent door 72 is slidably mounted adjacent to the vent opening 42 by a bracket 74 defining at least one slot 76 therein. A bracket 78 is secured to the vent door 72 and protrudes through the slot(s) 76. A rod 80 is pivotally secured at one end to the bracket 78 by a pivot 82, and pivotally secured at its other end by a pivot 84 to a bracket 86 that is secured to the rear door 66. Thus, when the rear door 66 is closed, the vent door 72 is in its forward position of FIG. 7, wherein the vent opening 42 is open. When the rear door 66 moves to its open position of FIG. 8, the vent door 72 is moved to its rearward position, closing the vent opening 42. In the illustrated example, the above-described components are structured so that the vent opening 42 becomes completely closed as soon as the rear door 66 is slightly opened.

The air valves 56 and 58 are operatively connected to controllers that can be operated by a drill operator from the surface. The air conduit 32 is connected to an air compressor on the surface. An example of a suitable air compressor is one that is capable of generating 1,150 $ft.^3$/min., which has been found to provide a pressure of 350 $lb./in.^2$ in an example device 10. The operative connection may be made through the use of electrical wiring extending from the drill to the device 10, or through any conventional wireless communication means having sufficient signal strength to communicate between the drill operator and the device 10 during a drilling operation. Such controls are well known to those skilled in the art and therefore not described in detail here.

Figure 12:
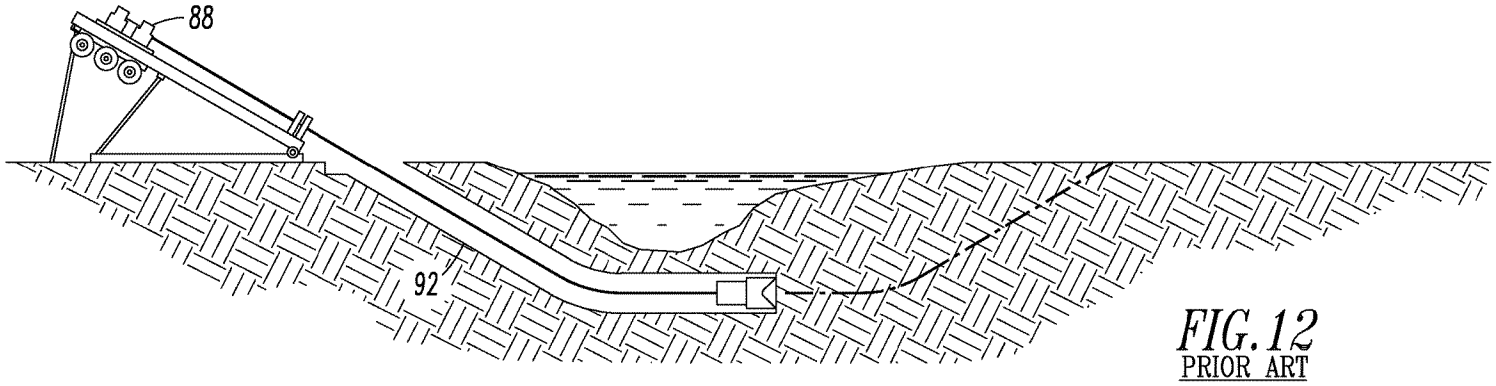
FIG. 12 PRIOR ART
FIG. 12 is a diagrammatic view of a conventional pilot hole directional drilling operation.
Figure 13:
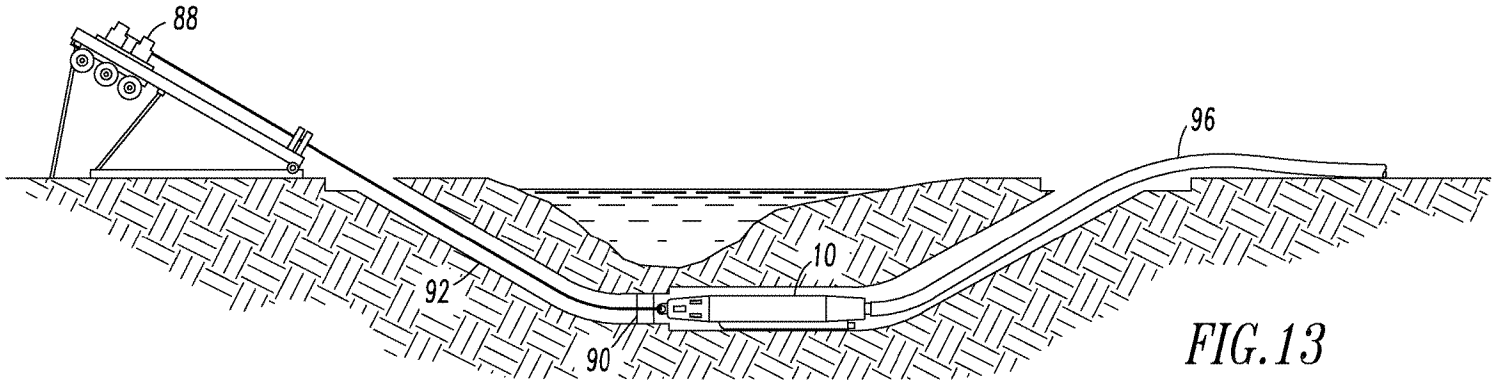
FIG. 13 is a diagrammatic view of a directional drilling reaming operation using a fluid removal device.
Figure 14:
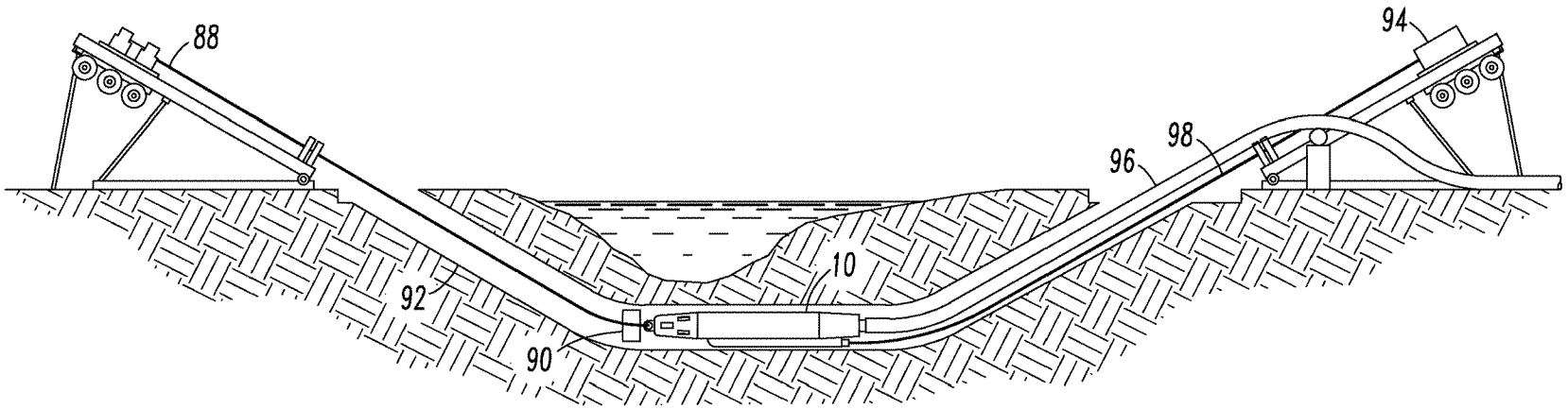
FIG. 14 is a diagrammatic view of a directional drilling reaming and pipe installation operation using a fluid removal device and a second drill.

A directional drilling operation is illustrated in FIGS. 12-14. A pilot hole is drilled in a conventional manner as shown in FIG. 12 by a drill 88. Next, as shown in FIGS. 13-14, the device 10 is placed behind a reamer 90 that is attached to the drill 88 that has just completed drilling a pilot hole for a bore 92. The device 10 may be attached to the drill 88 behind the reamer 90 (FIG. 13), or alternatively may be pushed behind the reamer 90 by a second drill 94 located on the opposite side of the bore hole 92 from the first drill 88 (FIG. 14). A pipe 96 may be attached to the device 10 (FIGS. 10-11, 14), and in the illustrated example the pipe 96 is welded to the flange 24 surrounding the outlet 22. The pipe 96 thus serves as the fluid discharge conduit as the device 10 is being used to install the pipe 96 into the borehole 92. The reamer 90 and device 10 are then passed through the bore hole as the hole is reamed and the pipe installed (FIGS. 13-14). The operation of the device 10 has been found to improve with increasing quantities of fluid used for the drilling operation, with at least about 40 gal./min. providing good results. The use of too little water will result in increased thickness of the mud being collected, increasing the difficulty in collecting the mud and increasing the likelihood of clogging the device 10.

As the device 10 passes through the bore hole, the doors 52 and 66 are in the position shown in FIG. 10, and the vent 42 is open. Mud and/or water within the bore hole passes through the inlets 22 into the interior portions 44 and 46. If the device must pass through fluid while descending into the bore hole, the vent 42 permits air to escape from the interior portion 46, thus reducing resistance to passage of the device 10 due to buoyancy caused by trapped air. When the interior portion 46 becomes filled with mud and/or fluid, high pressure air is caused to pass through the outlet 56, closing the door 52 and significantly increasing the pressure within the interior portion 46. Referring to FIG. 11, pressure within the interior portion 46 is increased sufficiently to force the fluid and/or mud through the door 66 and into the pipe 96, where the significant air pressure continues to drive the fluid and/or mud through the entire length of the pipe 96 and to a predetermined collection location. Experiments performed to this point have shown that the fluid and/or mud can be effectively "shot" out of the device 10, quickly clearing the device in preparation for additional fluid and/or mud removal. Once the air valve 56 is shut, the doors 52, 66 return to the positions shown in FIG. 10, and additional fluid and/or mud is collected by the device 10 in the same manner.

If separate reaming and pipe installation processes ale being performed, and/or if a second drill 94 is used to push the device 10, then when the device 10 reaches the bottom of a bore hole 92, it may remain there while the reaming process is completed. The device 10 may then either be pushed through the remainder of the borehole 92 to install the pipe 96, or retracted from the bore hole 96, depending on the operation being performed. If not already done, the pipe 96 may be installed in the remainder of the borehole 92. If reaming and pipe installation are being performed simultaneously, then the device 10 may follow the reamer 90 throughout the entire reaming process.

Once the device 10 reaches the opposite side of the bore hole 92, the pipe 96 (or other conduit if a pipe was not being installed) and conduit 98 of directional drill 94 (or other air conduit if a second drill 94 was not used) are cut or otherwise detached from the device 10, and the conduit 98 and any other conduits that were not intended to be installed in the borehole 92 may be retracted from the borehole 92.

By collecting and removing the mud and/or water within the bore hole, fluid pressure within the bore hole is reduced except at the location where hydraulic drilling is actually being performed—the only location at which pressure is desired. By reducing pressure in the remainder of the bore hole, any tendency towards unintended discharges due to fissures, holes, or other weaknesses in close proximity to the bore hole is reduced. Accordingly, project completion delays, government penalties, cleanup expenses, and other negative consequences of unintended discharges are also reduced.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A fluid removal device, comprising:

an elongated housing, the housing defining a front portion, a rear portion, and a central portion therebetween, the front portion of the housing defining at least one inlet, the rear portion of the housing defining an outlet, the outlet being structured to be connected to a pipe or hose, the housing further defining an exterior, the exterior including an attachment structure that is dimensioned and configured to attach to a directional drill or to another tool that is attached to a directional drill;

a forward valve disposed within the front portion of the housing, the forward valve being structured to permit fluid flow towards the central portion of the housing from the inlet when the forward valve is open, and to resist fluid flow between the inlet and the central portion when the forward valve is closed, the forward valve being structured to close upon an increase in pressure within the central portion of the housing;

a rear valve disposed within the rear portion of the housing, the rear valve being structured to resist fluid flow between the central portion of the housing and the outlet when the rear valve is closed, and to permit fluid flow between the central portion and the outlet when the rear valve is open;

a pressure increasing system within the central portion of the housing;

the fluid removal device being structured to collect fluid within a borehole by moving the fluid removal device through the borehole while permitting fluid to enter the housing through the inlet; and whereby increasing pressure within the central portion of the housing closes the forward valve and biases fluid within the central portion of the housing out of the outlet.

2. The fluid removal device according to claim 1, wherein the pressure increasing system is further structured to increase pressure within the forward portion of the housing, whereby the inlet is cleared.

3. The fluid removal device according to claim 1, wherein the forward valve includes a forward door and a valve opening, the forward door being structured to cover the valve opening when closed, the forward door being hingedly attached to an interior portion of the housing, the forward door being structured to be pushed open by fluid flow from the inlet into the central portion of the housing.

4. The fluid removal device according to claim 3, wherein the pressure increasing system includes a primary outlet disposed adjacent to the forward door within the central portion; whereby the forward door is pushed into a closed position by an increase in pressure within the central portion.

5. The fluid removal device according to claim 1, wherein the rear valve includes a rear door and a valve opening, the rear door being structured to cover the valve opening when closed, the rear door being hingedly attached to an interior portion of the housing, the rear door being structured to be pushed open by fluid flow from the central portion of the housing towards the outlet.

6. The fluid removal device according to claim 1, wherein the pressure increasing system is structured to be operatively connected to a directional drill, whereby pressure within the housing is increased by inserting air into the housing through the directional drill.

7. The fluid removal device according to claim 1, wherein the outlet includes an outlet flange, the outlet flange being structured to facilitate attachment of a pipe, whereby moving the fluid removal device through a borehole installs the pipe within the borehole.

8. A fluid removal device comprising:

an elongated housing, the housing defining a front portion, a rear portion, and a central portion therebetween, the front portion of the housing defining at least one inlet, the rear portion of the housing defining an outlet, the outlet being structured to be connected to a pipe or hose;

a forward valve disposed within the front portion of the housing, the forward valve being structured to permit fluid flow towards the central portion of the housing from the inlet when the forward valve is open, and to resist fluid flow between the inlet and the central portion when the forward valve is closed, the forward valve being structured to close upon an increase in pressure within the central portion of the housing;

a rear valve disposed within the rear portion of the housing, the rear valve being structured to resist fluid flow between the central portion of the housing and the outlet when the rear valve is closed, and to permit fluid flow between the central portion and the outlet when the rear valve is open;

a pressure increasing system within the central portion of the housing;

a vent disposed within the central portion of the housing; and a vent door that is structured to resist passage of air through the vent when the vent door is closed, and to permit passage of air through the vent when the vent door is open, the vent door being operatively connected to the rear valve, the vent door being structured to open when the rear valve is closed, the vent door being further structured to close when the rear valve is opened;

whereby increasing pressure within the central portion of the housing closes the forward valve and biases fluid within the central portion of the housing out of the outlet.

9. A fluid removal device comprising:

an elongated housing, the housing defining a front portion, a rear portion, and a central portion therebetween, the front portion of the housing defining at least one inlet, the rear portion of the housing defining an outlet, the outlet being structured to be connected to a pipe or hose;

a forward valve disposed within the front portion of the housing, the forward valve being structured to permit fluid flow towards the central portion of the housing from the inlet when the forward valve is open, and to resist fluid flow between the inlet and the central portion when the forward valve is closed, the forward valve being structured to close upon an increase in pressure within the central portion of the housing;

a rear valve disposed within the rear portion of the housing, the rear valve being structured to resist fluid flow between the central portion of the housing and the outlet when the rear valve is closed, and to permit fluid flow between the central portion and the outlet when the rear valve is open, the rear valve including a rear door and a valve opening, the rear door being structured to cover the valve opening when closed, the rear door being hingedly attached to an interior portion of the housing, the rear door being structured to be pushed open by fluid flow from the central portion of the housing towards the outlet;

a pressure increasing system within the central portion of the housing;

a vent disposed within the central portion of the housing; and a vent door that is structured to resist passage of air through the vent when the vent door is closed, and to permit passage of air through the vent when the vent door is open, the vent door being operatively connected to the rear door, the vent door being structured to open when the rear door is closed, the vent door being further structured to close when the rear door is opened;

whereby increasing pressure within the central portion of the housing closes the forward valve and biases fluid within the central portion of the housing out of the outlet.

10. A method of directional drilling, comprising:

drilling a hole using a directional drill;

attaching a reamer to the directional drill;

attaching a fluid removal device to the directional drill or to the reamer, the fluid removal device comprising:

an elongated housing, the housing defining a front portion, a rear portion, and a central portion therebetween, the front portion of the housing defining at least one inlet, the rear portion of the housing defining an outlet, the outlet being structured to be connected to a pipe or hose;

a forward valve disposed within the front portion of the housing, the forward valve being structured to permit fluid flow towards the central portion of the housing from the inlet when the forward valve is open, and to resist fluid flow between the inlet and the central portion when the forward valve is closed, the forward valve being structured to close upon an increase in pressure within the central portion of the housing;

a rear valve disposed within the rear portion of the housing, the rear valve being structured to resist fluid flow between the central portion of the housing and the outlet when the rear valve is closed, and to permit fluid flow between the central portion and the outlet when the rear valve is open; and a pressure increasing system within the central portion of the housing;

retracting the directional drill, the reamer, and the fluid removal device through the hole;

collecting fluid within the fluid removal device; and discharging the fluid from the fluid removal device by increasing pressure within the fluid removal device.

11. The method according to claim 10, further comprising attaching a pipe to the fluid removal device prior to retracting the directional drill through the hole.

12. The method according to claim 10, wherein pressure is increased within the housing by supplying compressed air to the housing.

13. The method according to claim 10, further comprising unclogging the inlet by increasing pressure within the housing adjacent to the inlet.

14. The method according to claim 13, wherein pressure is increased within the housing adjacent to the inlet using compressed air.

15. A method of directional drilling, comprising:

drilling a hole;

attaching a fluid removal device to a directional drill, the fluid removal device comprising:

an elongated housing, the housing defining a front portion, a rear portion, and a central portion therebetween, the front portion of the housing defining at least one inlet, the rear portion of the housing defining an outlet, the outlet being structured to be connected to a pipe or hose;

a forward valve disposed within the front portion of the housing, the forward valve being structured to permit fluid flow towards the central portion of the housing from the inlet when the forward valve is open, and to resist fluid flow between the inlet and the central portion when the forward valve is closed, the forward valve being structured to close upon an increase in pressure within the central portion of the housing;

a rear valve disposed within the rear portion of the housing, the rear valve being structured to resist fluid flow between the central portion of the housing and the outlet when the rear valve is closed, and to permit fluid flow between the central portion and the outlet when the rear valve is open; and a pressure increasing system within the central portion of the housing;

moving the directional drill and the fluid removal device through the hole;

collecting fluid within the fluid removal device; and discharging the fluid from the fluid removal device by increasing pressure within the fluid removal device.

16. The method according to claim 15, wherein:

the hole is drilled with a first directional drill located at a first end of the hole; and the fluid removal device is attached to a second directional drill located at a second end of the hole.

17. The method according to claim 16, further comprising:

attaching a reamer to the first directional drill; and retracting the first directional drill and the reamer through the hole ahead of the fluid removal device.

18. The method according to claim 15, wherein pressure is increased within the housing by supplying compressed air to the housing.

19. The method according to claim 15, further comprising unclogging the inlet by increasing pressure within the housing adjacent to the inlet.

20. The method according to claim 19, wherein pressure is increased within the housing adjacent to the inlet using compressed air.

* * * * *